US006048247A

United States Patent [19]

Kownacki et al.

[11] Patent Number: 6,048,247

[45] Date of Patent: Apr. 11, 2000

[54] MAIN WING POSITIONING AND RELEASE SYSTEM FOR A TOY AIRCRAFT

[75] Inventors: Charles D. Kownacki, Erie, Pa.; Jeffrey G. Rehkemper, Chicago, Ill.; Ronnen Harary, Toronto, Canada

[73] Assignee: SpinMaster Toys, Ltd, Toronto, Canada

[21] Appl. No.: 09/224,930

[22] Filed: Dec. 31, 1998

[51] Int. Cl.[7] ..... A63H 27/01; A63H 27/18

[52] U.S. Cl. ..... 446/66; 446/4; 446/61; 446/62

[58] Field of Search ..... 446/4, 6, 34, 55, 446/56, 57, 58, 59, 60, 61, 62, 66

[56] References Cited

U.S. PATENT DOCUMENTS

| | | | |
|---|---|---|---|
| 1,858,535 | 5/1932 | Adams | 446/59 |
| 2,275,094 | 3/1942 | Taylor | 446/66 |
| 2,347,689 | 5/1944 | Johnson | 446/57 |
| 3,827,181 | 8/1974 | Mabuchi | 446/57 |

FOREIGN PATENT DOCUMENTS

| | | | |
|---|---|---|---|
| 243943 | 12/1925 | United Kingdom | 446/66 |

*Primary Examiner*—Robert A. Hafer
*Assistant Examiner*—Jeffrey D. Carlson
*Attorney, Agent, or Firm*—M. K. Silverman

[57] ABSTRACT

A main wing positioning and release system particularly adapted for use with a toy or model aircraft, includes a wing positioning bracket upon the axial centerline of the aircraft, the bracket having projecting elements directed upwardly from the centerline of the aircraft. The system also includes a wing release mechanism including a lower portion press-fittably securable to the upwardly projecting elements of the positioning bracket to provide proper positioning of the release mechanism relative to the aircraft fuselage, a rear area of the lower portion including a press fittable receiving recess, an upper surface of the lower portion of the release mechanism proportioned for complemental engagement of a lower surface of the main wing. The wing release mechanism also includes an upper portion having upper and lower surfaces, the lower surface proportioned for complemental engagement of the top of the aircraft main wing, the upper portion including a press-fittable connection element complemental to the press-fittable receiving recess in which the recess and element are releasible from each other. A flexible normally openly biased hinge joins respective front edges of such lower and upper portions of the release mechanism from each other. Upon impact of the aircraft, as in a crash or emergency landing mode, the press fittable element and recess will separate from each other, releasing the main wing from the release mechanism without damage to the wing.

1 Claim, 4 Drawing Sheets

MAIN WING POSITIONING AND RELEASE SYSTEM FOR A TOY AIRCRAFT

REFERENCE TO RELATED APPLICATION

This use corresponds in subject matter to Provisional Application Number 60/081,423, filed Apr. 13, 1998.

BACKGROUND OF THE INVENTION

A long-standing problem in the design, operation and functionality of toy (also known as model) airplanes has been that of the vulnerability of the main wing structure to breakage and damage in the event of a crash or hard landing of such a model airplane. Frequently, in such "crashes" the main wing is the only part of model airplane that is materially damaged. Accordingly, a need has existed in the art of model airplanes for a wing support and release mechanism thru which, over a spectrum of crash scenarios, the main wing of the model aircraft would simply separate from the fuselage with little or no damage thereto. The instant invention therefore responds to this long-felt need in the art.

The inventor is unaware of any prior art applicable thereto.

SUMMARY OF THE INVENTION

The instant invention relates to a main wing positioning and release system particularly adapted for use with a toy or model aircraft. The system includes a wing positioning bracket upon the axial centerline of the aircraft, said bracket having projecting means directed upwardly from the centerline of the aircraft. The system further includes a wing release means including a lower portion press-fittably securable to said upwardly projecting means of said positioning bracket to thereby provide proper positioning of the release means relative to the aircraft fuselage, a rear area of said lower portion including first press fittable securement means, said upper surface of said lower portion of the release means proportioned for complemental engagement of a lower surface of the main wing. The wing release means also includes an upper portion having upper and lower surfaces thereof, said lower surface proportioned for complemental engagement of the top of said aircraft main wing, said upper portion including press-fittable connection means complemental to said press-fittable receiving means in which said means are releasible from each other. A flexible normally openly biased hinge joins respective front edges of said lower and upper portions of said release means from each other. Upon impact of the aircraft, as in a crash or emergency landing thereof, said press fittable means will separate from each other thereby releasing the main wing from the release means without damage to the wing. Alternatively, and dependent upon the particular crash mode, the lower portion of the release means will separate from the positioning support bracket, that is, said lower portion of the release means will lift of shear off of said upwardly projecting elements of the wing positioning and support bracket.

It is accordingly an object of the invention to provide a means of protection of a main wing of a model aircraft from damage in the event of a crash.

It is another object to provide a system of enlarging the usable life of a model aircraft.

It is a further object to provide a system of the above type having particular use with compressed air powered model aircraft.

The above and yet other objectives and advantages of the present invention will become apparent from the hereinafter set forth Brief Description of the Drawings, Detailed Description of the Invention.

DETAILED DESCRIPTION OF THE INVENTION

Figure 1:
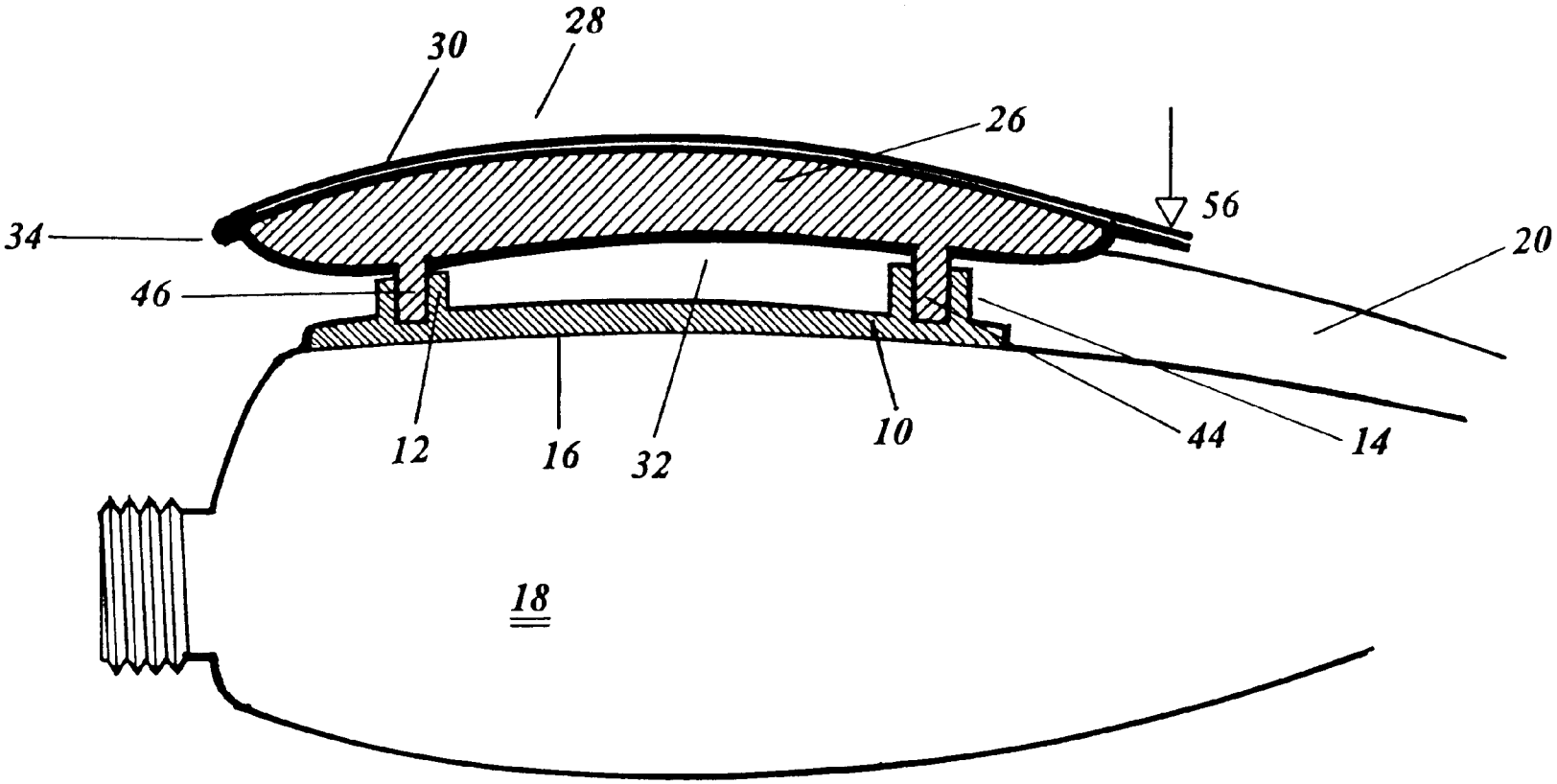
FIG. 1 is an axial cross-sectional view of the inventive wing positioning and release system shown in its closed position.
Figure 2:
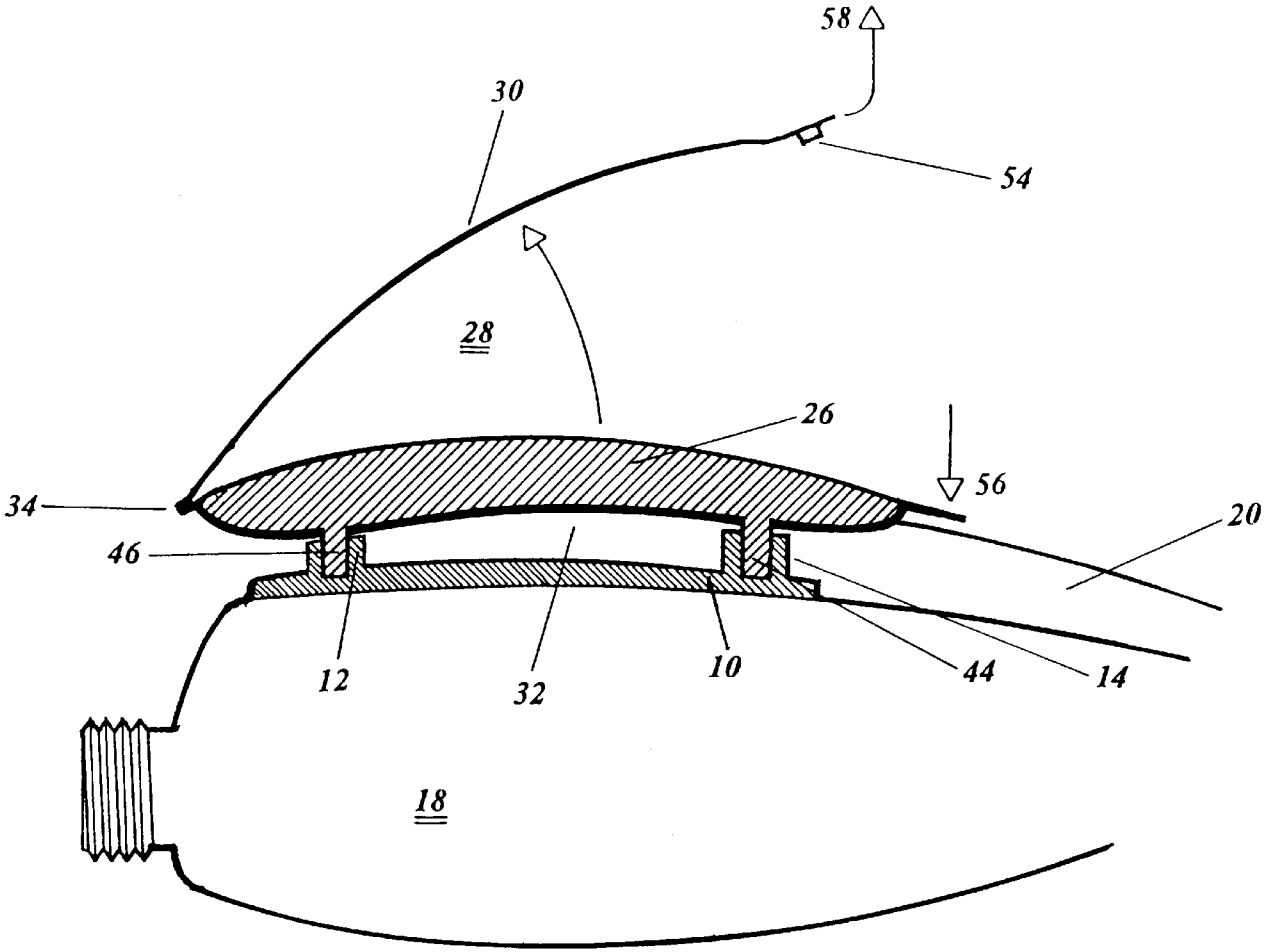
FIG. 2 is a view, similar to that of FIG. 1, however showing the release system in its open position.
Figure 6:
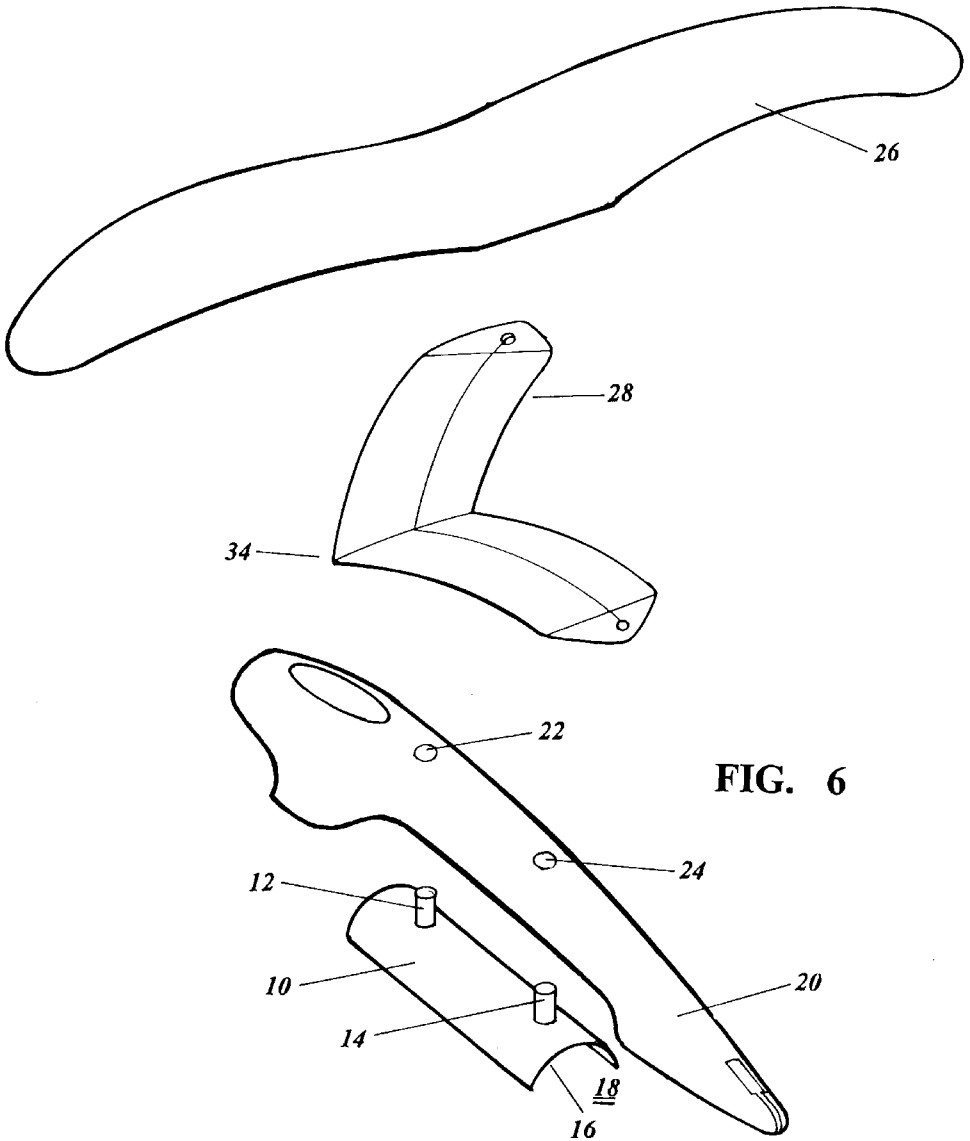
FIG. 6 is an exploded view showing the relationship of the respective components of the model airplane which are secured by the wing positioning and release system.

With respect to the views of FIGS. 1 and 2, the instant main wing positioning and support system may be seen to include a support bracket 10 which includes upwardly projecting means 12 and 14, each having cylindrical recesses therein. A bottom surface 16 of the support bracket 10 may be adhered to a compressed air reservoir 18 of a pneumatic engine toy aircraft. It is, however, to be understood, that the present invention is equally applicable to non-pneumatic toy aircraft. Accordingly, in such an application, bottom surface 16 of the support bracket would be adhered directly to the top of the aircraft fuselage. However, in the compressed air embodiment of the present system, a fuselage 20 (see FIG. 6) is positioned upon said projecting means 12 and 14 of the support bracket 10. This is accomplished through the use of holes 22 and 24 within the fuselage 20 which assures proper positioning of the support bracket and, as is more fully described below, with it, proper positioning of a main wing 26 of the aircraft itself.

Figure 4:
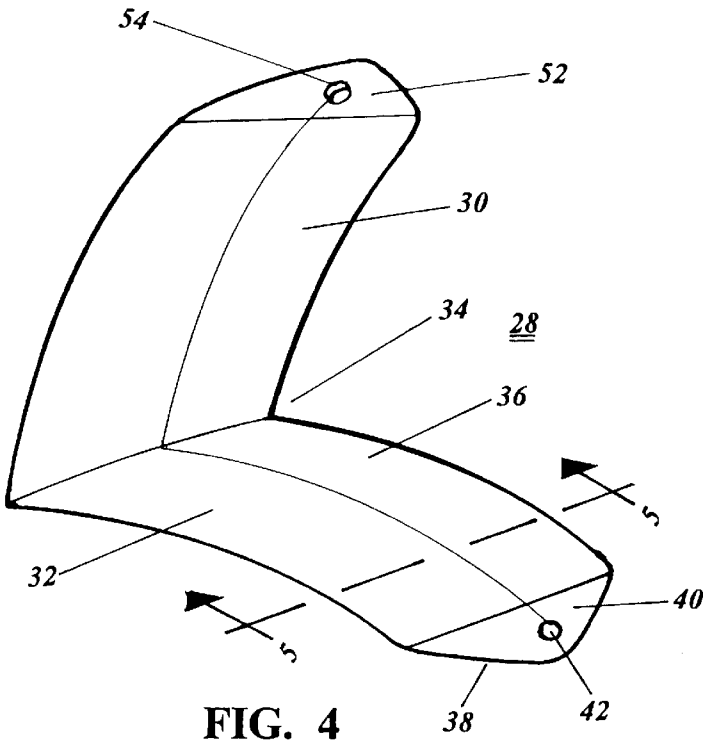
FIG. 4 is an axial cross-sectional schematic view taken along Line 4—4 of FIG. 3.
Figure 5:
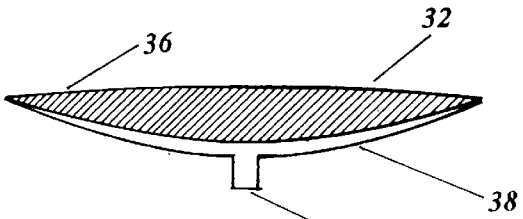
FIG. 5 is a cross-sectional radial schematic view taken along Line 5—5 of FIG. 3.
Figure 3:
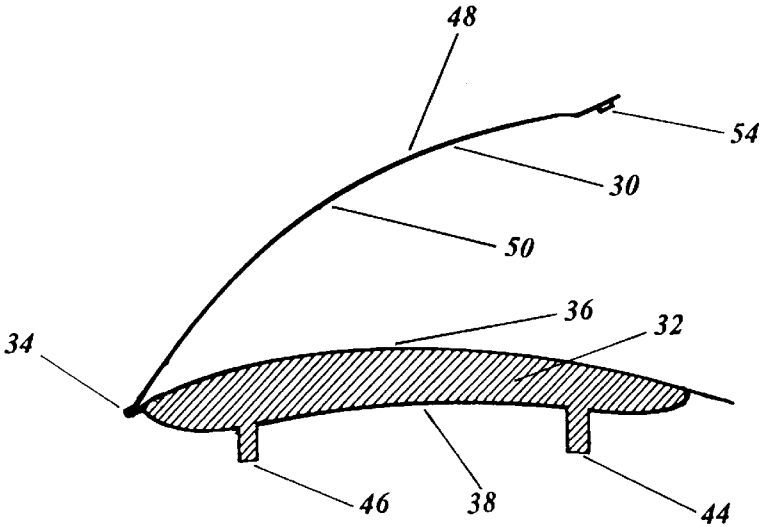
FIG. 3 is a perspective view of the wing positioning bracket of the present system.

The present invention is more particularly characterized by a main wing support 28 which includes an upper portion 30, a lower portion 32, and a so-called living hinge 34 integrally therebetween. This structure may be more fully appreciated with reference to the views of FIGS. 3, 4 and 5. Therein, lower portion 32 may be seen to include an upper surface 36, a lower surface 38, a planer transverse end surface 40 and, in said surface 40, a recess or press-fittable receiving means 42. See FIG. 3. In the views of FIGS. 4 and 5 may be seen downwardly protruding elements 44 and 46 which extend from lower surface 38 of lower portion 32 of the main wing support. Both elements 44 and 46 are proportioned for complemental press fittable insertion into the hollow recesses of projecting means 12 and 14 of support bracket 10. Further, upper surface 36 of lower portion 32 is proportioned for receipt of a linear surface of wing 26.

With respect to upper portion 30 of the main wing support 28 there is provided an upper surface 48 and a lower surface 50 thereto which is conformable to the top surface of wing 26. Upper portion 30 also includes a transverse end surface 52 and, integrally therewith, a connecting means or a male element 54 which is proportioned for press fittable receipt by said receiving means 42 of transverse surface 40 of the lower portion 32 of the main wing support 28.

The arrangement and function of the above elements may be more fully appreciated with reference to the axial cross-sectional views of FIGS. 1 and 2. Therein, in FIG. 1, may be seen the wing support 28 in its fully closed position, which is accomplished by pressing upper portion 30 downward onto lower portion 32 as is indicated by arrow 56. This results in the press-fittable connection of male element 54 of surface 52 of upper portion 30 to receiving means 42 of transverse surface 40 of lower portion 32 of the wing support. Thereby, the main wing 26 is conformally held by the upper and lower surfaces of the wing support, however, in a manner such that, in the event of an impact thereto, particularly from the front of the aircraft, the upper portion 30 (see FIG. 2) will spring upward as a result of the impact-induced detachment of male element 54 from receiving means and the function of so-called living hinge 34 of the wing support, which is biased upwardly in direction 58. As such, the upper portion 30 may open relative to the lower portion 32 an unlimited number of times without damage to the structure of the main wing support. Resultingly, in most "crashes" of a model aircraft equipped with the present wing positioning and release system, the main wing 28 will be harmlessly thrown free of the model airplane.

It should be further noted that, given the present design, even in those crashes in which the main wing 28 is broken or damaged, a substitute or spare wing may be readily dropped into place, i.e., an extra main wing may be carried by the model airplane enthusiast in the fashion that one carries an extra or spare tire in an automobile.

In other types of impact, that is, impact in which side or lateral forces are imparted to the main wing, downwardly projecting elements 44 and 46 from lower portion 32 of the wing support 28 will pull free from their press fittable connection into the recesses of the projecting elements 12 and 14 of the support bracket 10 by shearing away the entire main wing support 28 and, with it, main wing 26 free of the airplane fuselage 20.

In terms of system materials, it is noted that the main wing 28 is preferably formed of styrofoam while the support bracket 26 and main wing support 28 are preferably formed of a light styrene which is a light but hard plastic. Such materials contribute to protection of the main wing from damage in the event of excessive impact.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

Having thus described my invention what I claim as new and useful and non-obvious and, accordingly, secure by Letters Patent of the United States is:

1. A main wing positioning and release system for a toy aircraft, the system comprising:

(a) a support bracket proportioned for securement to the top of a fuselage of said aircraft and positioning along the axial centerline thereof at a location at which a main wing of the aircraft is to be secured, said bracket including upwardly projecting elements thereof; and (b) a wing release means comprising:

(i) a lower portion having an upper and lower surface thereof, said lower surface press-fittable securable to said upwardly projecting elements of said support bracket, a rear transverse surface of said lower portion including press fittable receiving means thereon, said upper surface of said lower portion proportioned for engagement of a bottom surface of an aircraft main wing;

(ii) an upper portion having upper and lower surfaces thereof, said lower surface proportioned for complemental engagement with a top of said aircraft main wing, said upper portion, at a transverse end thereof, including press fittable securing means complemental in geometry to said first complemental securement means of said lower portion, said receiving and securing means releasable from each other in the event of impact including an axial component of force; and (d) flexible openly biased hinge means integrally joining respective front opposing edges of said upper and lower portions to each other, in which, upon release of said receiving and securing means from each other, said flexible hinge will urge said upper portion open relative to said lower portion thereby permitting release of the main aircraft wing in the event of a crash of the model aircraft, whereby, upon an impact upon the main wing having an upward force component thereof, the lower portion of the wing release means will release from the support bracket, releasing the entire upper and lower portions of the wing release means and, with it, the main wing, from the aircraft fuselage.

* * * * *